US008221013B2

(12) United States Patent
Salciarini

(10) Patent No.: US 8,221,013 B2
(45) Date of Patent: Jul. 17, 2012

(54) MAKEUP DEVICE INCLUDING A WIPER

(75) Inventor: Christian Salciarini, Couilly Pont aux Dames (FR)

(73) Assignee: Chanel Parfums Beaute, Neuilly-sur-Seine (FR)

( * ) Notice: Subject to any disclaimer, the term of this patent is extended or adjusted under 35 U.S.C. 154(b) by 1005 days.

(21) Appl. No.: 12/166,708

(22) Filed: Jul. 2, 2008

(65) Prior Publication Data

US 2009/0065019 A1 Mar. 12, 2009

Related U.S. Application Data

(60) Provisional application No. 60/949,592, filed on Jul. 13, 2007.

(30) Foreign Application Priority Data

Jul. 5, 2007 (FR) ..... 07 56290

(51) Int. Cl.
*A46B 17/00* (2006.01)

(52) U.S. Cl. ..... 401/122; 401/121; 401/127; 401/129; 132/218

(58) Field of Classification Search ..... 401/118, 401/121, 122, 126, 127, 129; 132/218
See application file for complete search history.

(56) References Cited

U.S. PATENT DOCUMENTS

| | | | | |
|---|---|---|---|---|
| 4,470,425 | A | 9/1984 | Gueret | |
| 5,096,319 | A * | 3/1992 | Gueret | 401/126 |
| 5,803,638 | A | 9/1998 | Gueret | |
| 5,961,238 | A | 10/1999 | de Bruin et al. | |
| 6,010,265 | A * | 1/2000 | Bouix | 401/122 |
| 6,033,142 | A | 3/2000 | Gueret | |
| 6,076,985 | A | 6/2000 | Gueret | |
| 6,261,017 | B1 | 7/2001 | Gueret | |
| 6,283,659 | B1 | 9/2001 | Gueret | |
| 6,290,416 | B1 | 9/2001 | Gueret | |
| 6,502,584 | B1 | 1/2003 | Fordham | |
| 7,182,535 | B2 * | 2/2007 | Lim | 401/129 |
| 2009/0028627 | A1 | 1/2009 | Gueret | |

FOREIGN PATENT DOCUMENTS

| | | | |
|---|---|---|---|
| EP | 0728426 | A1 | 8/1996 |
| EP | 0829211 | A1 | 3/1998 |
| FR | 2504788 | A1 | 11/1982 |
| KR | 242001 | | 7/2001 |
| WO | 9101097 | A1 | 2/1991 |
| WO | 2007004156 | A1 | 1/2007 |

* cited by examiner

*Primary Examiner* — Steven J Ganey
(74) *Attorney, Agent, or Firm* — Jacox, Meckstroth & Jenkins

(57) ABSTRACT

The makeup device in particular for making up the eyelashes and/or the eyebrows, comprises a reservoir an applicator and a wiper comprising bellows and scrapers projecting from the bellows for the purpose of scraping the applicator.

13 Claims, 6 Drawing Sheets

MAKEUP DEVICE INCLUDING A WIPER

CROSS-REFERENCE TO RELATED APPLICATIONS

This application is a non-provisional of U.S. Provisional Patent Application Ser. No. 60/949,592 filed Jul. 13, 2007 and also claims priority to French Application No. 0756290 filed Jul. 5, 2007, which applications are incorporated herein by reference and made a part hereof.

FIELD OF THE INVENTION

The invention relates to makeup devices, particularly but not exclusively to devices for applying makeup to the eyelashes and/or the eyebrows.

BACKGROUND OF THE INVENTION

By way of example, document FR-2 504 788 discloses a makeup device in which a reservoir is provided in its neck with a wiper having at its bottom end radial tongues that, at rest, lie in a plane extending perpendicularly to a direction in which the applicator is extracted from the reservoir. The free ends of the tongues are spaced apart from one another so as to leave a circular opening in the center of the wiper. Such an arrangement makes it possible, while extracting the applicator from the reservoir, to remove any excess makeup from the surface of the brush. Nevertheless, makeup accumulates at the free end of the brush, from which makeup is poorly eliminated by the wiper because of the central orifice in the wiper. This drip of excess makeup, or "glob", must nevertheless be eliminated by the user prior to putting the applicator into contact with the eyelashes, since otherwise the drip would become deposited as a whole on the eyelashes. It turns out to be awkward for the user to eliminate this drip from the brush insofar as the user usually holds the reservoir in one hand and the applicator in the other. The user may attempt to remove the glob by putting the end of the applicator into contact with the inside of the neck, but not only is this operation awkward to perform, it is not certain to achieve the desired result.

OBJECTS AND SUMMARY OF THE INVENTION

An object of the invention is to improve the wiping of the applicator so as to make applying makeup easier.

To this end, the invention provides a makeup device in particular for making up the eyelashes and/or the eyebrows, the device comprising:

- a reservoir;
- an applicator; and
- a wiper comprising bellows and scrapers projecting from the bellows for the purpose of scraping the applicator.

Thus, the bellows allow the scrapers to move away from one another (even at their bases), and it enables them to do so independently of any scraper deformation that might occur. The wiper is thus much more capable than in the prior art of matching the shape of the profile of the applicator over the entire length thereof, and of doing so progressively while the applicator is being extracted from the reservoir. This is particularly advantageous if the transverse profile of the endpiece of the applicator is not constant along the applicator. This variable feature may apply to the profile of a core of the endpiece, or to the profile of a surface envelope defined by the bristles or teeth of the endpiece, or indeed to both profiles simultaneously. Where appropriate, the wiper can thus open wide in order to fit over the largest section of the applicator, and then shrink elastically so as to fit over one or more narrow sections of the applicator. In particular, at the end of the applicator, the wiper closes so as to eliminate the glob. The user thus extracts from the reservoir an applicator that does not have a drip of makeup at its end. The invention also avoids the defect of certain prior art wipers that, in spite of having a frustoconical profile at rest, nevertheless tend to take on a cylindrical bushing or sleeve state on coming into contact with the endpiece for wiping, such that the surface of the wiper bears against the endpiece and slides over it without wiping it. Because of the bellows, the wiper of the invention keeps its scrapers with the same orientation during wiping. In addition, the invention makes it possible to give the wall of the wiper smaller thickness, so as to limit the forces exerted on the endpiece, thereby in particular preserving the fibers, bristles, or teeth as the case may be, and its entire surface in general. This also preserves the wiper.

Advantageously, the device is arranged in such a manner that the scrapers extend in a plane perpendicular to an extraction direction for extracting the applicator from the reservoir, at least when a stem of the applicator lies in register with the wiper.

Thus, the scrapers present an orientation that is particularly suitable for achieving maximum scraping of the surface of the applicator.

Advantageously, each scraper presents a free end of concave shape.

Thus, since the applicator generally presents a section that is locally convex in shape, the scrapers fit particularly closely to the shape of its section. This makes it possible to perform uniform wiping all around the longitudinal axis of the applicator, e.g. in order to leave a constant quantity of makeup around its axis.

Preferably, each scraper presents a free end that does not have a corner between its two ends.

Advantageously, each scraper presents a free end that is of curved shape.

Thus, the applicator is likewise usually of curved section, and regular wiping is achieved of the section of the applicator around its axis.

Provision can be made for the scrapers to present free ends that extend one another, preferably continuously, at least when the entire applicator lies outside the reservoir.

Advantageously, the wiper leaves an opening for the reservoir, at least when the entire applicator lies outside the reservoir.

Advantageously, the wiper closes the reservoir at least when the entire applicator lies outside the reservoir.

Thus, there is no fear of a component of the makeup evaporating while the applicator is in use. The rheological properties of the makeup are thus preserved for as long as possible, which properties can be of major importance in applying makeup successfully.

Advantageously, the applicator includes a stem having a portion of section that is smaller than that of some other portion of the stem, and forms a housing, the device being arranged in such a manner that the scrapers extend into the housing when the applicator closes the reservoir.

This avoids pointlessly stressing the material forming the scrapers and the bellows when the device is not in use. This therefore preserves the elastic qualities of the material for as long as possible.

The device may also present at least one of the following characteristics:

- the bellows presents folds;
- some of the folds project and other folds are indented;
- the number of projecting folds and the number of indented folds are both equal to six; and each scraper extends between two projecting folds relative to a circumferential direction about a main axis of the wiper.

The invention also provides a wiper for a makeup device, the wiper comprising bellows and scrapers projecting from the bellows towards a main axis of the wiper.

BRIEF DESCRIPTION OF THE DRAWINGS

Other characteristics and advantages of the invention appear further from the following description of a preferred embodiment and of variants given by way of non-limiting example and with reference to the accompanying drawings, in which.

MORE DETAILED DESCRIPTION

Figure 1:
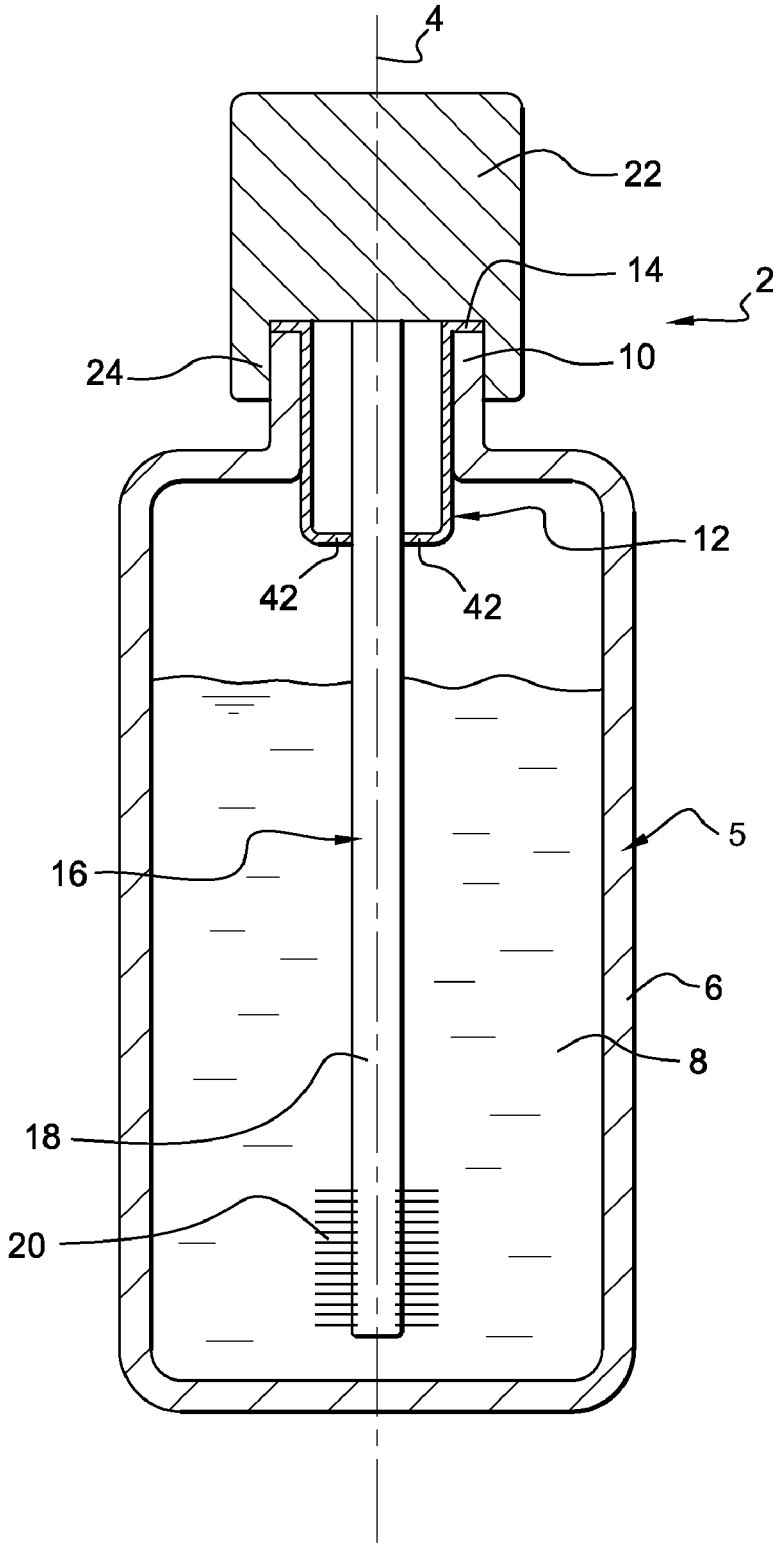
FIG. 1 is an axial section view of a makeup device in a preferred embodiment of the invention.
Figure 2:
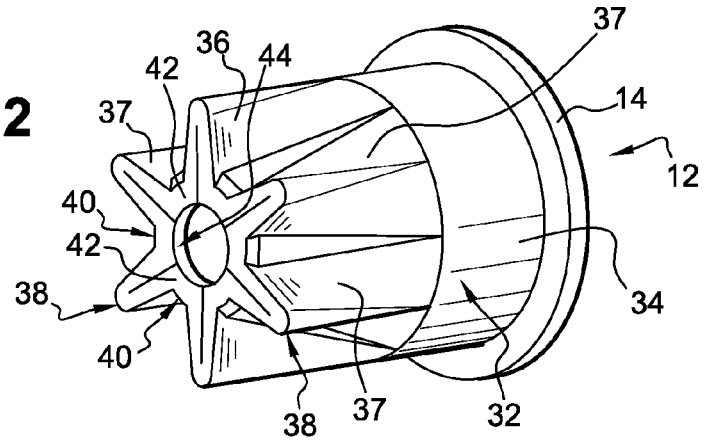
FIGS. 2, 3, and 4 are respectively a perspective view, an elevation view, and a view from beneath of the wiper of the FIG. 1 device showing in the retracted configuration.
Figure 3:
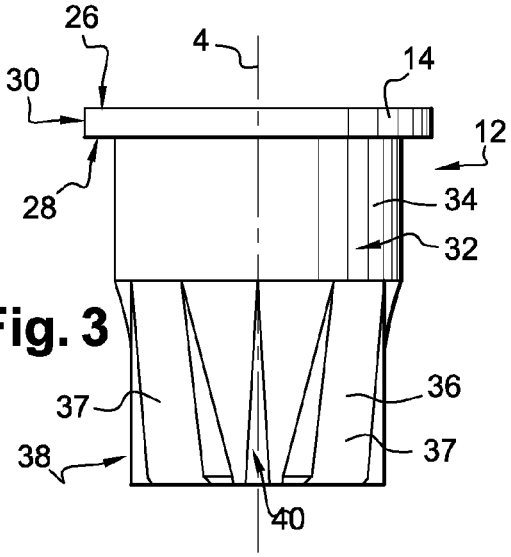

In the description below, terms such as "lower", "upper", "top", and "bottom" are used relative to the device in a vertical position as shown in FIG. 1.

A preferred embodiment of the makeup device of the invention is described below with reference to FIGS. 1 to 11 and 18. Specifically, the device 2 is for making up the eyelashes. In other embodiments, the device could be for making up the eyebrows or other portions of the face or the body.

The device 2 presents a longitudinal direction represented by a main axis 4. Unless specified to the contrary, all of the portions of the device present symmetry of revolution about this axis.

The device 2 comprises a reservoir 5 comprising a bottle 6 containing makeup 8, constituted in this example by mascara. The reservoir 5 has a neck 10 at the top of the bottle 6, which neck is of narrower section than the bottle in a plane perpendicular to the axis 4. The neck forms the outlet from the reservoir.

The device 2 includes a wiper 12 fastened to the reservoir 5 by being engaged in the neck 10. For this purpose, the wiper 12 includes a rim 14 that bears against the top end edge of the neck 10 along the direction of the axis 4. The wiper bears in a radial direction over the entire height of the neck against its inside face. The wiper also extends in the axial direction along axis 4 beyond the neck into the bottle 6.

Finally, the device 2 includes an applicator 16 having a stem 18, a makeup endpiece 20 fastened to the bottom end of the stem, and a closure member 22 fastened to the top end of the stem. The closure member is secured rigidly to the stem and acts as a handle for holding the applicator while applying makeup. The closure member 22 presents a bottom skirt 24 into which the neck 10 penetrates when the closure member 22 closes the reservoir. In this position, the stem 18 passes through the neck and the wiper 12 and extends into the bottle. The endpiece 20 extends in the bottom portion of the bottle and is immersed in the makeup 8. The neck 10 in this example presents a thread (not shown) on its outside face, and the skirt 24 presents a thread (not shown) on its inside face suitable for co-operating with the thread on the neck in order to provide a screw-and-nut assembly enabling the closure member to be fastened onto the reservoir so as to close it. The closure member then comes into axial abutment against the rim 14 of the wiper so as to close the reservoir in sealed manner.

There follows a description in greater detail of the wiper 12, given in particular with reference to FIGS. 2 to 6 in which the wiper is shown in its retracted configuration. The rim 14 mentioned above is generally annular in shape. It presents a plane top face 26, a plane bottom face 28, and a cylindrical side face 30. Each of the faces 26 and 28 extend in a plane perpendicular to the axis 4.

The wiper 12 includes a skirt 32 presenting a top portion 34 and a bottom portion 36. The top portion 34 is contiguous with the rim 14 from which it extends downwards, assuming that the axis 4 extends in a vertical direction. The top portion presents outer and inner cylindrical faces of circular section in a plane perpendicular to the axis 4. In this example, the top portion extends specifically over less than half the height of the skirt 32 along the axis 4, but over more than one-third of said height.

The bottom portion 36 presents bellows 37 defined by projecting folds 38 and indented folds 40 as observed from outside the wiper when it is outside the reservoir. There may be a local reduction in the thickness of the material occupying the folds in order to improve the hinge effect. In this example there are six projecting folds and similarly six indented folds 40 that alternate therewith around the axis 4. These folds are distributed regularly about the axis 4. The number of folds could be increased or decreased.

The wiper 12 includes scraper elements 42 that can be referred to as scrapers, as teeth, or indeed as flaps. There are six scrapers 42 in this example and they are identical to one another. Each of them is plane in shape and presents relatively small thickness. The six scrapers occupy a common plane perpendicular to the axis 4, as can be seen in particular in FIGS. 5 and 6. Each scraper 42 in this example presents an edge 44 referred to herein for convenience as its central bottom edge because of its proximity to the axis 4. This edge is of curved shape and locally gives the scraper a concave shape. The six edges 44 run on continuously one from another so that when the wiper is in its retracted position as shown in FIGS. 2 to 6, these edges together form a circular central opening 46 in the bottom portion of the wiper. Specifically, the edges 44 lie in a plane that is perpendicular to the axis 4.

Each scraper also presents two rectilinear edges 48 referred to for convenience herein as side edges. For each scraper, each of its two side edges comes into linear contact with a side edge 48 of one of the adjacent scrapers in the retracted position. Each edge 48 extends from the opening 46 from one of the ends of the central edge 44. In this example, the side edges 48 present an orientation that is radial relative to the axis 4. Each edge 48 has its other end situated not far from a projecting fold 38, but not going as far as the fold. This end is situated in register with the corresponding indented fold.

Figure 5:
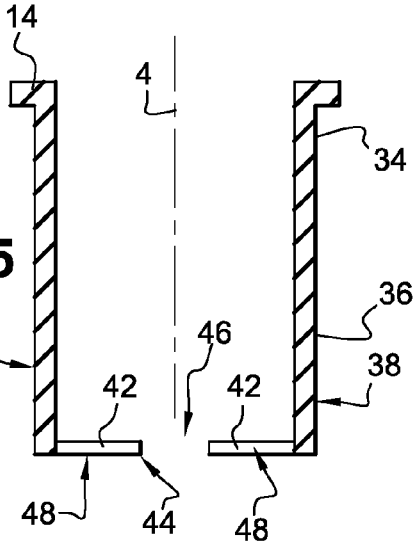
FIGS. 5 and 6 are section views respectively on planes V-V and VI-VI showing the FIG. 4 wiper.
Figure 6:
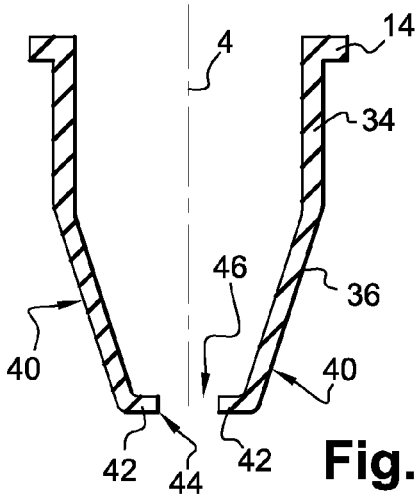

FIG. 5 thus shows a section of the wiper taken through the projecting folds 38. The side edges 48 of the scraper coincide with the plane of this section. It can be seen that in this example the projecting folds 38 extend the outside face of the top portion 34 parallel to the axis 4. In FIG. 6, the section is on a plane containing the indented folds 40, thereby giving the section of the bottom portion 36 a trapezoidal shape.

The intersections between the bellows and the scrapers 42 define outside edges thereof. Thus, each scraper presents a central outer edge 50 of convex circular shape concentric with the outer central edge 44. The scraper also presents two outer side edges 52 both of which are rectilinear in shape. The three edges 50 and 52 are not scraper edges, unlike the edges 44 and 48. The edges 50 extend in the indented folds 40 and constitute the bottom ends thereof. In this example, each indented fold 40 is formed not by a line but by an elongate triangular facet with its apex contiguous with the top portion 34 and its base formed by the corresponding edge 50. In this example, the indented fold 40 is thus formed by two successive indented folds. The edges 52 form the bottom ends of the walls of the bellows interconnecting the projecting folds 38 and the indented folds 40.

Figure 4:
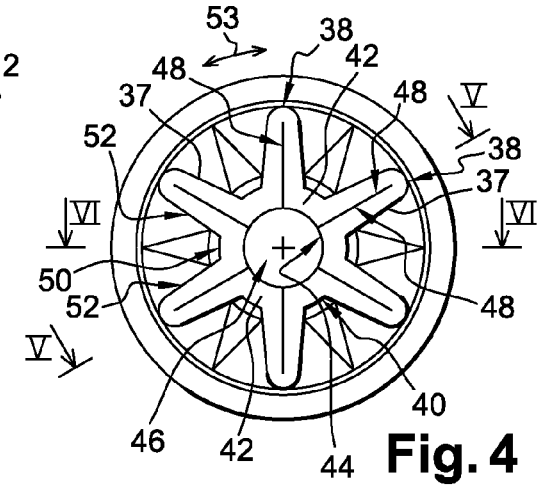

The bottom portion of the wiper in the retracted position, as can be seen in end view in FIG. 4, thus presents the shape of a six-pointed star. This star is pierced in its center by the opening 46 and it presents slots formed by the edges 48 extending from said opening along respective points of the star. The points are marked by the outer edges 52. In FIG. 4, it can be seen that in the present example each scraper 42 extends between two successive projecting folds 38 relative to a direction 53 that is circumferential about the axis 4. In other words, each scraper extends over an angular sector defined by the axis (forming the vertex of the angle) and two successive projecting folds 38.

FIGS. 5 and 6 show that the scrapers 42 extend, inside the wiper, projecting radially towards the axis 4 from the other portions of the wiper, in particular the bellows 37, the top portion 34, and the rim 14.

The wiper 12 is preferably made as a single piece of plastics material such as an elastomer, e.g. a thermoplastic elastomer. Because of their good injection-molding properties, it is possible to select a styrene-ethylene-butylene-styrene (SEBS) type styrene-based thermoplastic elastomer (TPE-S) of the type comprising a copolymer with ethylene, butylene, and styrene blocks, a vulcanized ethylene, propylene, diene monomer (EPDM) type olefin-based thermoplastic elastomer (TEP-O); or indeed a urethane-based thermoplastic elastomer (TPE-U). The hardness of the material may lie in the range 20 to 60 on the Shore scale. The absence of any undercut shape enables the part to be made by molding without difficulty. The edges 48 can be made after the part has been extracted from the mold by cutting slots in the bottom wall of the wiper.

Figure 7:
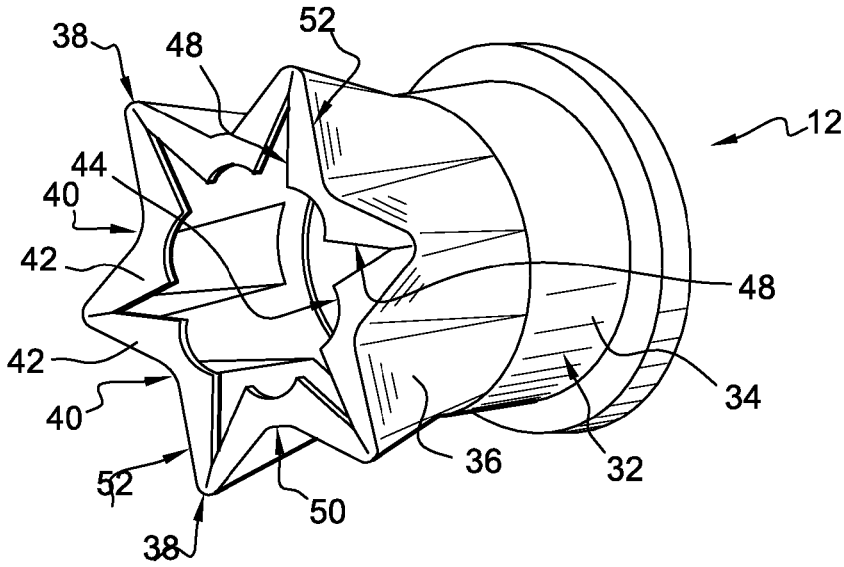
FIGS. 7 to 9 are views analogous to FIGS. 2 to 4, showing the wiper in the extended configuration.
Figure 8:
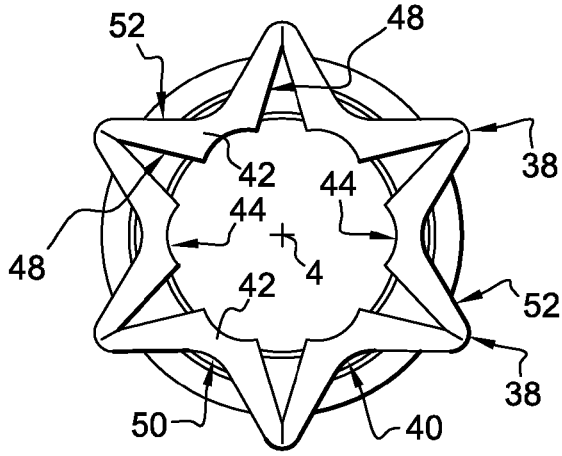
Figure 9:
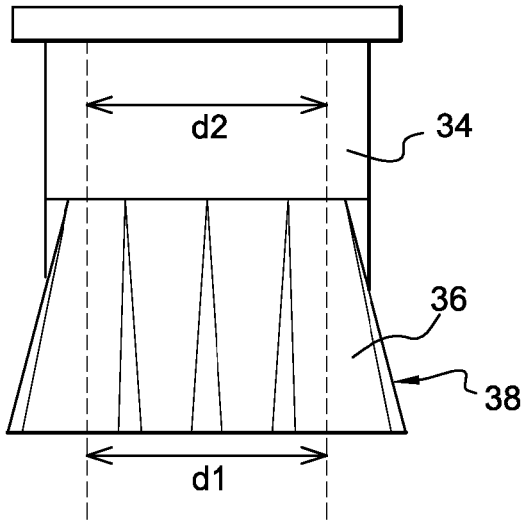

As shown in FIGS. 7 to 9, the wiper 12 may have an extended configuration in which each scraper 42 occupies a position that is further from the axis 4 than the position it occupies in the rest position as shown in FIGS. 2 to 6. This is true of all points of a scraper. The scrapers are also spaced apart from one another so that the side edges 48 of adjacent scrapers are no longer in contact with one another except via their ends furthest from the axis. The central edges 44 are likewise spaced apart from one another such that on enlarging the opening 46 loses its circular shape. Its shape becomes closer to that of a star by virtue of the initially contiguous side edges 48 moving apart.

During this extension, the projecting folds and the indented folds open so as to enable the walls of the bellows 37 to move apart. The maximum extension of the bellows may, for example, be as shown by the central edges 44 of the scrapers being at a distance d1 (shown in FIG. 9) that is equal to the diameter d2 measured on the cylindrical inner face of the top portion 34 of the skirt. This extension is greater than that of a traditional wiper because of the structure of the bottom portion 36.

In order to enable maximum extension of the bellows 37, it is advantageous to fasten the wiper in the neck in such a manner that contact with the inside face of the neck takes place only over the top portion 34 of the skirt and not over the bottom portion 36, with the bottom portion extending entirely into the bottle 6 so as to be free to open.

Figure 10:
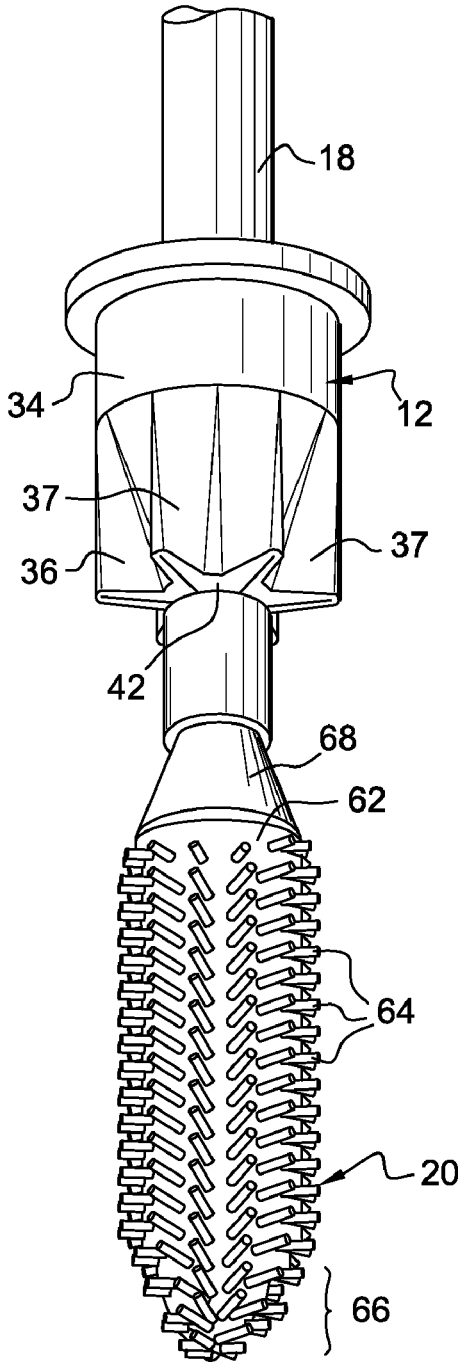
FIGS. 10 and 11 are perspective views of the applicator and of the wiper showing respectively the applicator prior to passing through the wiper on extraction of the applicator from the reservoir, and while it is passing through the wiper during said extraction.
Figure 11:
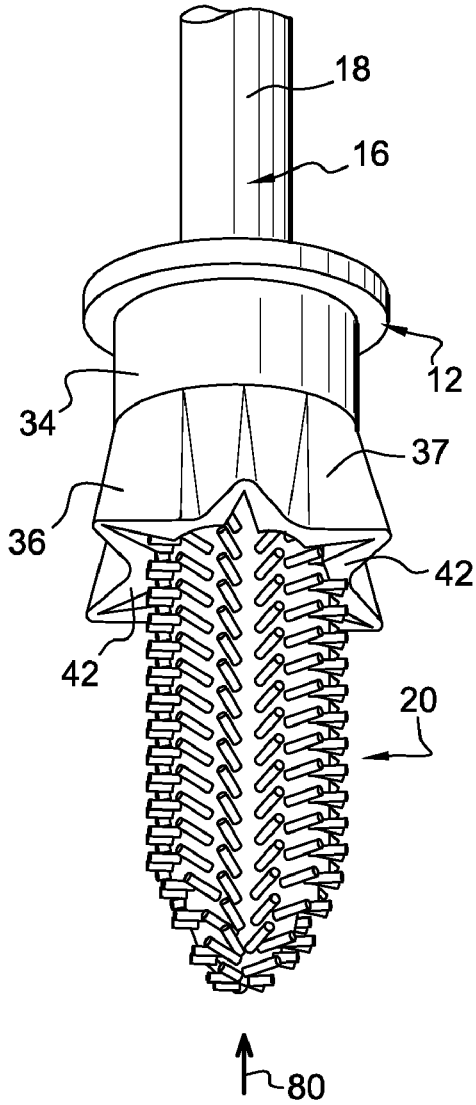

The endpiece 20 of the applicator in the present example is shown in greater detail in FIGS. 10 and 11. In this example the endpiece is a brush. Specifically, the brush comprises a core 62 and bristles 64 made integrally with the core. By way of example, such a brush is made by injection molding. The bristles are uniformly distributed around the axis 4 and along the brush. The brush presents a free end portion 66 of section extending transversely relative to the axis that tapers to its free end. This tapering applies both to the length of the bristles and to the transverse diameter of the core 62. In this example, the applicator 16 presents a junction between the endpiece 20 and the stem 18 in the form of a ramp 68 that forms a transition zone between the core 62 and the stem 18. This ramp is in the form of a truncated cone, with the larger section of the cone being contiguous with the core 62 and with the diameter in this location being greater than the diameter of the stem.

As shown in FIG. 1, when the closure member 22 closes the reservoir, the endpiece extends into the bottle 6 and is immersed in the makeup 8. As shown in FIGS. 1 and 10, the wiper 12 then presents its retracted configuration, the stem 18 occupying the opening 46. It is preferable to make provision for the edges 44 to be in contact with the stem without the scrapers or the bellows being subjected to stress in a radial direction.

In order to apply makeup, the user unscrews the closure member 22 and then progressively extracts the applicator along the direction of arrow 80 until it has been extracted fully from the reservoir. During extraction, the scrapers 42, by means of their central edges 44, begin by scraping the stem 18 until they reach the ramp 68. As shown in FIG. 11, by cooperating with the central edges 44, the ramp causes the bottom portion 36 to open progressively by expanding the bellows 37. This opening continues when the scrapers come into contact with the brush. During this opening, the scrapers remain oriented in a plane that is perpendicular to the axis 4. Essentially they do no more than move apart from one another. Although opening the bellows tends to tilt the scrapers outwardly relative to the plane perpendicular to the axis 4, this tilting is compensated by the stress exerted by the brush on the scrapers along the axis 4 towards the stem.

While the brush is being extracted, the central and side edges 44 and 48 scrape the bristles of the brush and, depending on the configuration of the brush and the scraper, possibly also scrape the core of the brush. The scraped-off makeup builds up against the bottom outer faces of the scrapers and then drops back into the reservoir.

When the on-going extraction puts the reduced section portion 66 into register with the scrapers, the wiper begins to reclose in order to follow the shape of this section while continuing scraping. This closing movement continues until reaching the free end. The central edges 44 then remain in contact with the portion of the end of the brush until the entire brush has left the wiper. Any drip of makeup that might have collected at the end of the brush during wiping is thus eliminated at the end of wiping by coming up against the scrapers 42.

The wiper changes from its retracted configuration to its extended configuration and vice versa by elastic deformation of the material from which it is made, in particular in the bellows. The wiper returns to its retracted position by elasticity. The indented folds and the projecting folds act like hinges. Thus, the wiper opens under the effect of stress from the applicator and closes spontaneously when that stress ceases. The applicator can be passed through the wiper while applying little force because of the elasticity of the bottom portion 36. Nevertheless, the scrapers provide effective scraping.

Provision can be made for the wiper to preserve a supply of makeup in the vicinity of the core, by imparting sufficient length and stiffness to the bristles. The wiper would then scrape the core only moderately, if at all. This reserve of makeup would then become progressively released while applying makeup to the eyelashes, whereby avoiding the need for the user to refill the brush frequently with makeup. Depending on the shape of the core, this reserve of makeup on the endpiece may be uniform in cross-section relative to the axis, and/or along the axis.

The shape of the scrapers in the wiper and the dimensions of the wiper could be modified, as could the shape of the brush, in particular the dimensions of the core, depending on the nature of the wiping it is desired to perform. Thus, different variant embodiments of the brush are shown in FIGS. 12 to 17.

Figure 12:
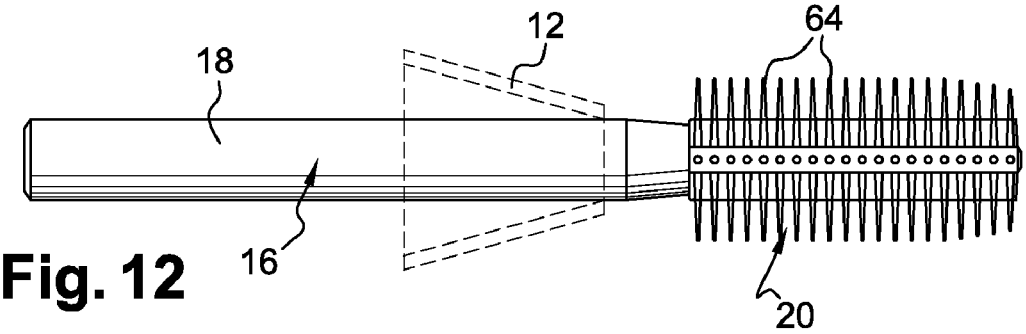
FIGS. 12 to 17 are side views showing how the wiper and the applicator co-operate in other embodiments.

In the variant of FIG. 12, the core presents a cylindrical face of diameter that is smaller than the diameter of the stem 18. The bristles 64 define a cylindrical envelope structure over a major fraction of the brush as measured along its axis 4, with the diameter of the envelope being greater than that of the stem. It can be seen that the wiper of the invention under such circumstances has the effect of performing wiping that preserves a reserve of makeup in the vicinity of the core. The envelope of this reserve is of cylindrical shape and occupies an extension of the stem, being of the same diameter as the stem in this example. The envelope is thus set back from the free ends of the bristles. The reserve forms a sheath around the core.

Figure 13:
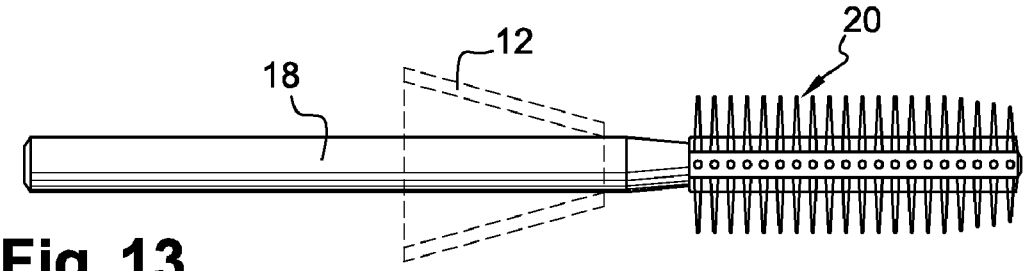

In the variant of FIG. 13, an identical effect is shown with the exception that the difference in diameter between the core and the stem is smaller. Whereas in FIG. 12 the diameter of the core is equal to about one-third the diameter of the stem, this ratio is reduced to half in this example. The reserve of makeup constituted along the core during wiping is thus thinner and therefore smaller. It should be observed that the length of the bristles remains unchanged between these two figures.

Figure 14:
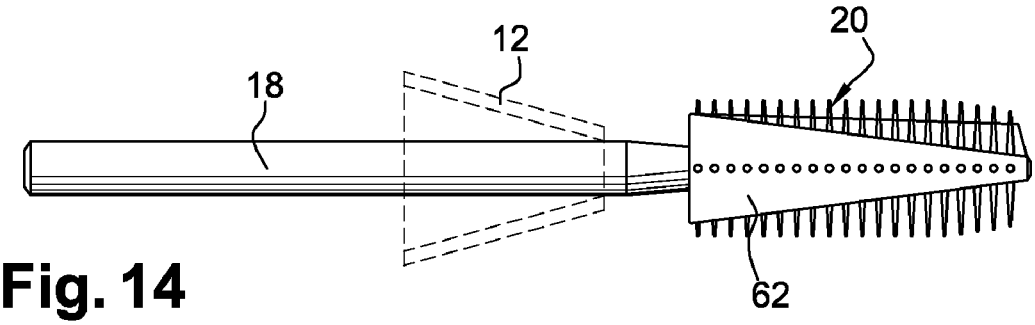
Figure 15:
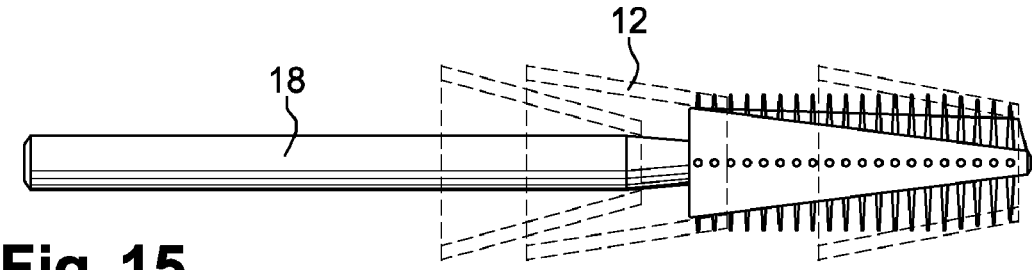

In the variant of FIG. 14, the core 62 presents a frustoconical shape, tapering on going towards the free end of the endpiece. The largest-diameter section of the core is itself of diameter greater than that of the stem 18. The smallest-diameter section of the core has a diameter that is smaller than that of the stem 18. As shown in FIG. 15 that shows the wiper in a plurality of positions, this arrangement has the effect of constituting a serve of makeup having an outer face that is cylindrical in shape. The mass of makeup therefore increases with decreasing diameter of the core along the endpiece. The mass of makeup that is thus reserved is therefore greater locally when the local section of the core is small. In this example likewise, the reserve is nevertheless set back from the free ends of the bristles and presents an envelope surface that is cylindrical over the major fraction of the length of the endpiece.

Figure 16:
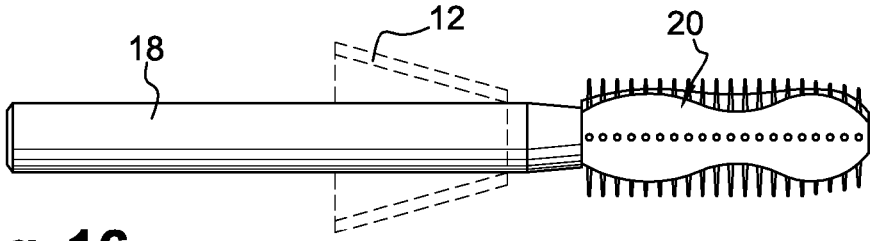
Figure 17:
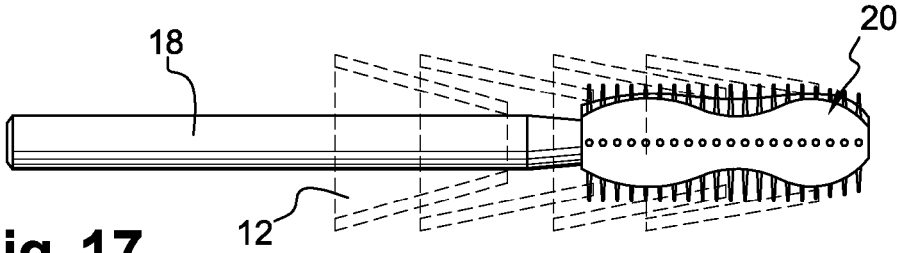

In another variant shown in FIGS. 16 and 17, the core may have a section that is not constant and that varies in non-monotonic manner. In the present example, the longitudinal section of the core presents a profile referred to as an hourglass-shape. Thus, starting from the stem, it initially increases, then it narrows, and then it increases again, before finally decreasing, so as to have two larger-diameter zones both with the same diameter. Once again, wiping creates a reserve of makeup along the brush, which reserve is locally greater when the section of the core is smaller. Once again, the bristles have free ends that project beyond the reserve. The envelope surface in this example also presents an hourglass-shape but that is less marked than the hourglass-shape of the core. This envelope surface could equally well be cylindrical over the major fraction of the length of the core if the stiffness of the wiper were to be reduced.

Figure 18:
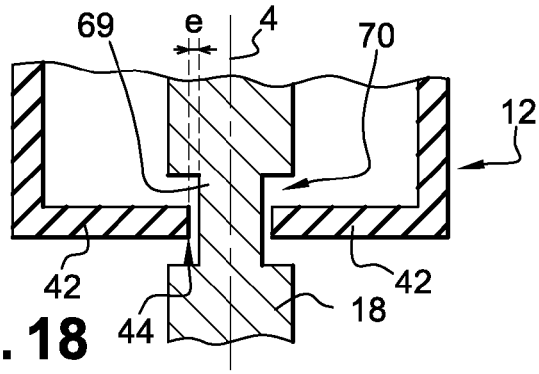
FIGS. 18 and 19 are section views showing a detail of the wiper and of the stem in two respective variant embodiments.

In the variant of FIG. 18, the device is identical to that of FIG. 1 except that the stem 18 presents an intermediate portion 69 of diameter smaller than the diameters of the other portions of the stem. The edge 44 presents a diameter that is smaller than the diameter of the major portion of the stem but larger than the diameter of this portion 69. This portion forms a housing 70 and is designed to extend in register with the scrapers when the closure member closes the reservoir, as shown in FIG. 1. The scrapers 42 then extend into the housing to within a distance e (FIG. 18) from the stem when the device is closed. This avoids applying any stress to the scrapers and the bellows in a radial direction, in particular. The edges of the portion 69 also extend away from the scrapers in the axial direction. Any axial stress on the scrapers is likewise avoided. This arrangement also has the advantage of providing effective scraping of the surface of the stem insofar as the scrapers are once more subjected to radial stress during extraction of the applicator as soon as they come into contact with a portion of the stem other than the portion 69.

Figure 19:
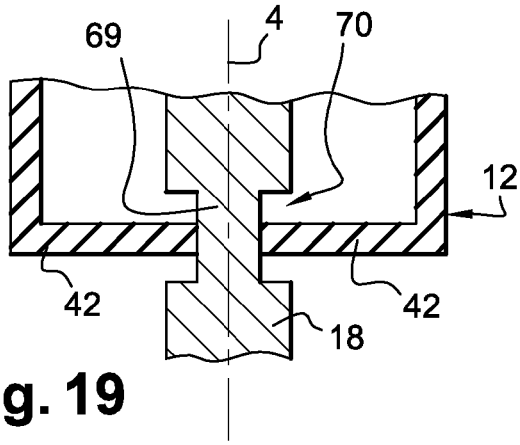

FIG. 19 shows a variant of the device that differs from the variant of FIG. 18 insofar as the tips of the scrapers in this example may contact with the stem in the housing 70. This arrangement provides additional closure for the reservoir in register with the portion 69 when the device is closed.

Figure 20:
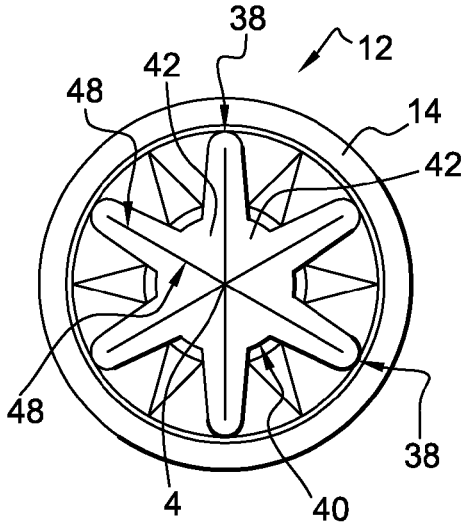
FIG. 20 is a view analogous to FIG. 4 showing a variant embodiment of the wiper.

Another variant is shown in FIG. 20. The device is identical to that of FIG. 1 except that it differs therefrom by the opening 46 being omitted. The scrapers do not have any central edges 44 and their side edges 48 intersect on the axis 4. The scrapers thus present central triangular tips. All of the tips come into contact with one another on the axis. The advantage of this arrangement is that it closes the wiper when the applicator is fully extracted from the reservoir. Thus, while the user is applying the makeup, the makeup 8 that remains in the reservoir does not come into contact with the atmosphere, thereby avoiding evaporation of any of its components. The rheological qualities of the mascara are thus reserved for longer. Furthermore, any risk of a drip of makeup remaining on the end of the endpiece on its extraction from the reservoir is eliminated because there is no central opening.

The wiper of the invention adapts particularly well to the shape of the endpiece, regardless of what that shape might be. It is particularly well adapted to endpiece profiles that are not circular in a plane that is perpendicular to the axis 4, e.g. profiles that are polygonal (of square, triangular, etc. section).

Naturally, numerous modifications could be applied to the invention without going beyond the ambit thereof.

Mention is made above of the function of the edges of the scrapers adjacent to the bottom face of the wiper. In certain embodiments, the thickness of each scraper can be so fine as to make it difficult to distinguish between the bottom edges of the scrapers and their top edges. Under such circumstances, it is the entire edge surface of a scraper and not just its bottom edge that it involves during wiping.

Naturally, the shape of the various portions of the wiper could be modified, in particular the shapes of the bellows and of the scrapers. It is possible to vary the number of these members by increasing the number or by reducing the number.

In particular at its endpiece 20, the applicator could have a very variety of configurations. Thus, the endpiece may constitute a comb rather than a brush. It could also be an endpiece comprising one or more brush sectors and/or one or more comb sectors, these sectors being longitudinal, for example.

The bristles need not be integral with the core, but they could be fitted thereto, e.g. by flocking. The brush could include bristles that are fastened by means of a twisted core, in a manner that is itself known.

The bellows could be constituted by undulations in the wall of the bottom portion 36 instead of using folds.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A makeup device for making up the eyelashes and/or the eyebrows, the makeup device comprising:

a reservoir;

an applicator;

a wiper comprising a plurality of bellows arranged in succession around an axis of said wiper; and scrapers projecting from said plurality of bellows for scraping said applicator in response to an extraction or removal of said applicator from said reservoir in order to remove excess makeup from a surface of said applicator;

said plurality of bellows being adapted to permit said scrapers to move in response to a profile of said applicator when said applicator is extracted from said reservoir.

2. The makeup device according to claim 1, arranged in such a manner that each of said scrapers extend in a plane perpendicular to an extraction direction for extracting the applicator from the reservoir, at least when a stem of the applicator lies in register with the wiper.

3. The makeup device according to claim 1, in which each of said scrapers presents a free end of concave shape.

4. The makeup device according to claim 1, in which each of said scrapers presents a free end that does not have a corner between its two ends.

5. The makeup device according to claim 1, in which each of said scrapers presents a free end that is of curved shape.

6. The makeup device according to claim 1, in which each of said scrapers present free ends that extend one another, preferably continuously, at least when the entire applicator lies outside the reservoir.

7. The makeup device according to claim 1, arranged so that the wiper leaves an opening for the reservoir, at least when the entire applicator lies outside the reservoir.

8. The makeup device according to claim 1, arranged in such a manner that the wiper closes the reservoir at least when the entire applicator lies outside the reservoir.

9. The makeup device according to claim 1, in which the applicator includes a stem having a portion that is smaller than that of some other portion of the stem, and forms a housing, the makeup device being arranged in such a manner that the scrapers extend into the housing when the applicator closes the reservoir.

10. The makeup device according to claim 1, in which said plurality of bellows presents folds.

11. The makeup device according to claim 10, in which some of the folds project and other folds are indented.

12. The makeup device according to claim 11, in which the number of projecting folds and the number of indented folds are both equal to six.

13. The makeup device according to claim 1, in which each of said scrapers extends between two projecting folds relative to a circumferential direction about a main axis of the wiper.

* * * * *